United States Patent [19]

Kashima

[11] 4,188,775

[45] Feb. 19, 1980

[54] FREQUENCY ADJUSTMENT MEANS FOR ELECTRIC TIMEPIECE

[75] Inventor: Yoshinobu Kashima, Tanashi, Japan

[73] Assignee: Citizen Watch Company Limited, Japan

[21] Appl. No.: 851,187

[22] Filed: Nov. 14, 1977

[30] Foreign Application Priority Data

Nov. 16, 1976 [JP] Japan ..... 51/136864
Aug. 9, 1977 [JP] Japan ..... 52/95469

[51] Int. Cl.[2] ..... G04C 17/02
[52] U.S. Cl. ..... 58/23 AC; 58/23 R
[58] Field of Search ..... 58/23 R, 23 A, 23 AC, 58/23 D

[56] References Cited

U.S. PATENT DOCUMENTS

| | | | |
|---|---|---|---|
| 3,914,931 | 10/1975 | Tsuruishi | 58/23 R |
| 3,945,194 | 3/1976 | Gollinger | 58/23 R |
| 3,978,649 | 9/1976 | Naito | 58/23 R |
| 4,045,952 | 9/1977 | Kashio | 58/23 R |
| 4,051,663 | 10/1977 | Chihara et al. | 58/26 R |
| 4,055,945 | 11/1977 | Schwarzschild et al. | 58/85.5 |

FOREIGN PATENT DOCUMENTS

| | | | |
|---|---|---|---|
| 568611 | 10/1975 | Switzerland | 58/23 R |

*Primary Examiner*—Gene Z. Rubinson
*Assistant Examiner*—John B. Conklin

[57] ABSTRACT

An electronic timepiece having an integrated circuit including a high frequency oscillator with a frequency divider circuit for dividing the high frequency output to provide a low frequency time unit signals. A time counter circuit responds to the time unit signals and develops time information signals. A decoder is coupled to the time counter circuit and provides display information signals in response to the time information signals. A driver circuit provides drive signals in response to the display information signals and an electro-optical device responds to the drive signals to display time information. A frequency adjustment circuit adjusts the high frequency signal to a correct value and has a plurality of frequency adjustment ratio setting terminals selectively coupled to output terminals of the driver circuit to develop outputs representative of frequency adjustment ratios. Pulse generating circuitry is provided for generating output pulses in dependence upon the output signals and the high frequency signal is adjusted to a correct valve in response to output pulses.

12 Claims, 14 Drawing Figures

DISPLAY DEVICE 48
48a
48b
48c
48d
DRIVER 44
44a
44b
44c
44d
46
46a
46b
46c
46d
46e
46f
46g
DECODER 32
36
38
40
42
50
A25
A24
A3
A4
A5
A6
A7
A8
A9
A10
A11
A12
A13
A14
A15
A16
A17
A18
A19
A20
A21
A22
A23
P1
P2
P3
P4
P5
P6
P7
P0
FROM Fig. IA
TO Fig. Ic
φ2
φ3
S
28
30
64
66
68
SECONDS COUNTER 18
1-MINUTE COUNTER 20
10-MINUTE COUNTER 22
1-HOUR COUNTER 24
10-HOUR COUNTER 26
COUNTER CIRCUIT 16

(a)

(b)

FREQUENCY ADJUSTMENT MEANS FOR ELECTRIC TIMEPIECE

BACKGROUND OF THE INVENTION

This invention relates to digital frequency adjustment means suitable for use in an electronic timepiece, particularly a digital electronic timepiece, for the purpose of adjusting to a desired value the output frequency of a frequency divider circuit in an electronic timepiece of the type which displays time by using the divider circuit to divide the frequency of a standard oscillator circuit, the output of the divider circuit then being used to drive time display means.

In recent years the utilization of ICs in digital electronic timepiece circuitry has become quite pronounced, and in particular there has been rapid development toward the adoption of large scale integration (LSI) in which single-function IC groups are mutually wired on a circuit board and closely integrated. However, where electronic circuits are constructed through IC and LSI techniques, an extremely important problem in view of the accurate production and operation of semiconductor devices is reducing the number of terminals of the semiconductor devices which construct the electronic circuitry. Moreover, in order to allow this electronic circuitry to drive an electro-optical display device such as liquid crystal cells or light emitting diodes, which possess a comparatively large number of terminals, a very large proportion of the terminals which the electronic circuitry possesses must be expended to provide a connection to the electro-optical display device.

It is desirable to reduce the number of circuit terminals in order to conserve space since most timepiece components such as the electro-optical display device, the electronic circuitry, crystal oscillator and battery must be accommodated in the limited confines of a watch case, especially if the case is designed for a wristwatch. However, reducing the number of circuit terminals in present electronic wristwatches can entail reducing the number of electrodes that provide a connection to the display device and the control switches, a sacrifice that has been difficult to make since this necessarily limits timepiece operability and function. In addition, there is a tendency today toward the production of digital electronic timepieces which possess a number of functions such as chronograph, worldtime and calculator functions, a condition which calls for an ever greater number of control switch terminals while the number of circuit terminals has also steadily increased for the same reasons. Hence, it has been extremely difficult to reduce the cost and size of the electronic circuitry and assure the reliability of its connections.

Under these circumstances, frequency adjustment in a conventional electronic timepiece, in which oscillation is produced by a crystal oscillator, was accomplished by varying the capacity of a variable condenser connected to the oscillator circuit which made it possible to adjust its frequency. In the limited confines of an electronic wristwatch, however, a sufficient adjustable range could not be obtained since it was necessary to make use of a variable condenser which was small in size. Another defect resides in the fact that the temperature-humidity characteristics of the oscillator circuit vary widely depending upon environmental conditions and the passage of time due to the instability of the variable element.

In an effort to overcome these defects there have been proposed a number of so-called digital frequency adjustment systems in which the output frequency of a frequency divider circuit is adjusted by varying its adjustment ratio while leaving the frequency obtained from the oscillator circuit untouched. However, all of these systems are disadvantageous in that they require providing a large number of terminals for setting the adjustment ratio in order to allow the output frequency of the divider circuit to be adjustable over a wide range.

SUMMARY OF THE INVENTION

It is accordingly the object of the present invention to provide an electronic timepiece equipped with means for varying frequency adjustment ratio, and having frequency adjustment means which makes it possible to adjust frequency over a wide range while substantially reducing the number of circuit terminals for extablishing the adjustment ratio.

Figure 4A:
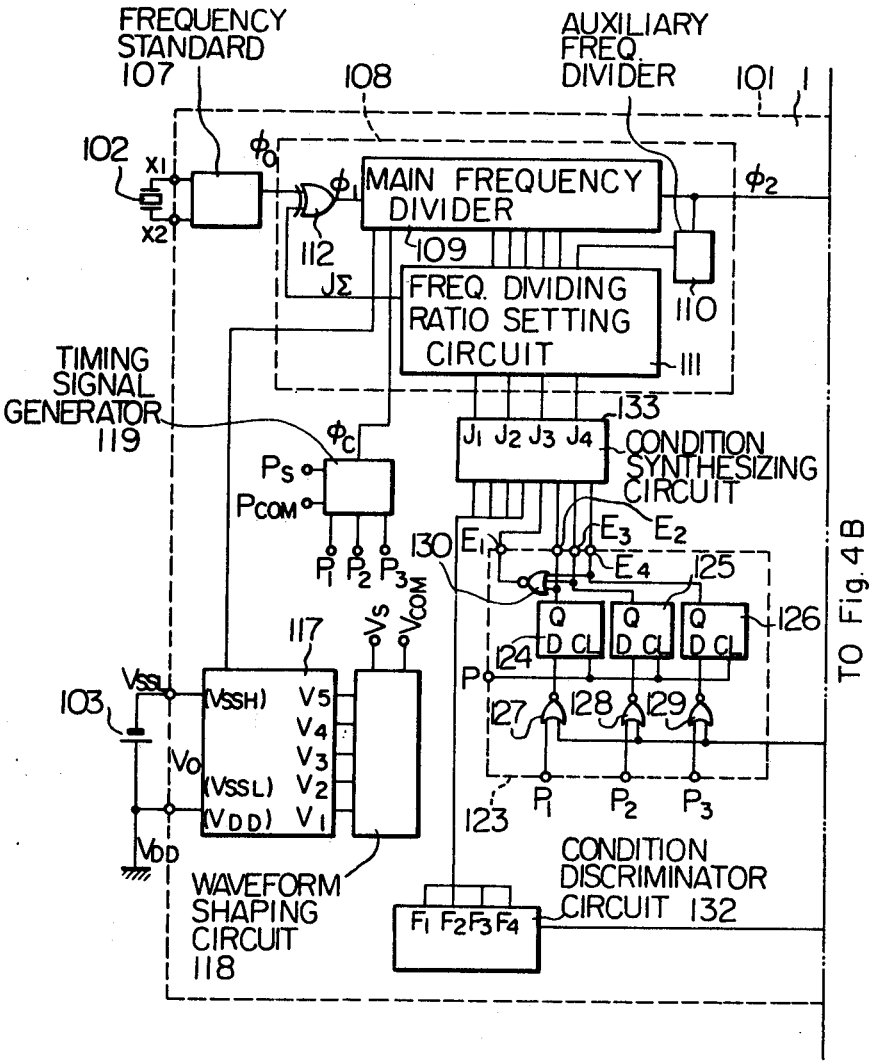
FIG. 4A and 4B illustrate is a block wiring diagram of another preferred embodiment of an electronic timepiece according to the invention.
Figure 4B:
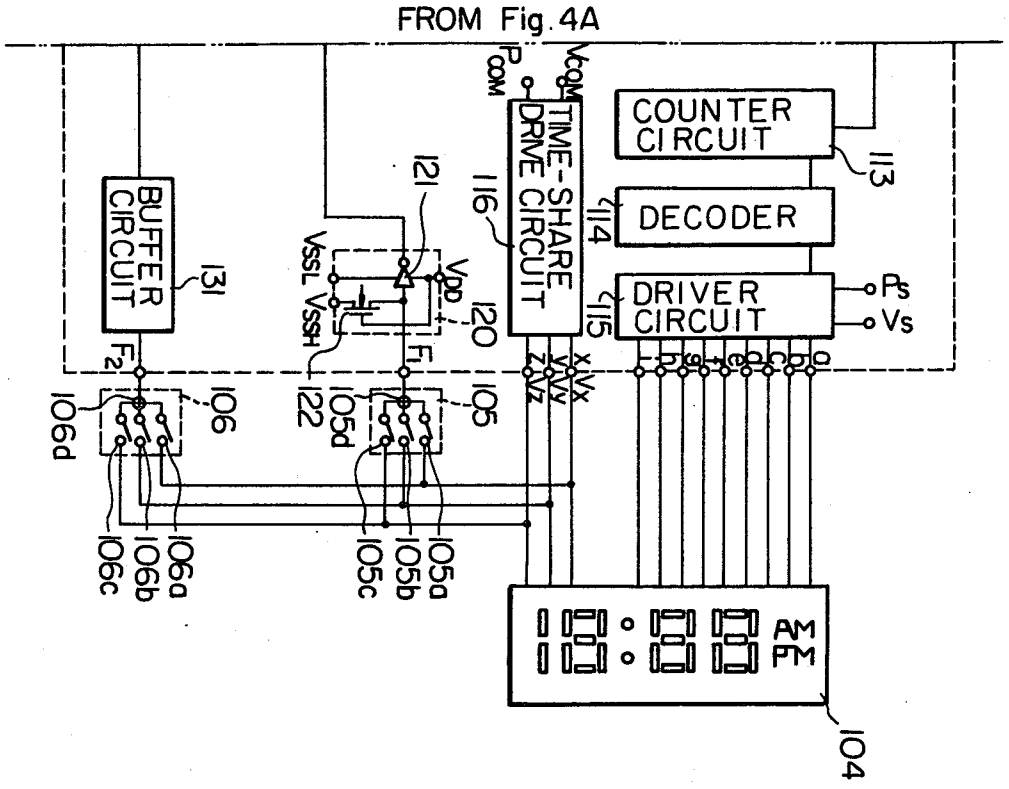
Figure 5:
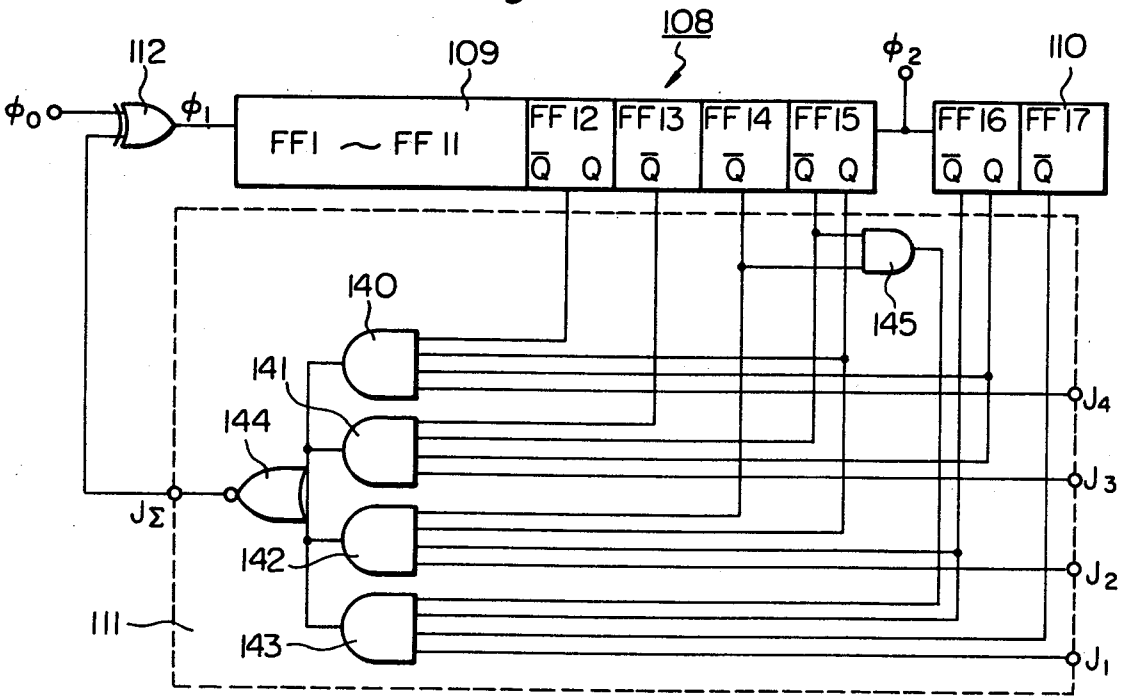
FIG. 5 shows the construction of the variable frequency divider illustrated in FIG. 4A and 4B.
Figure 7:
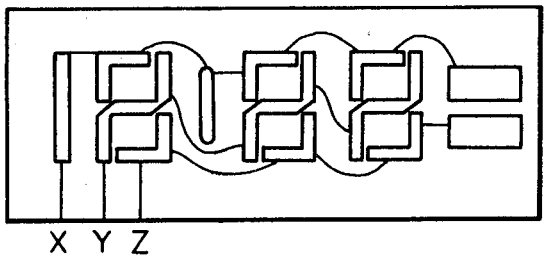
Figure 7:
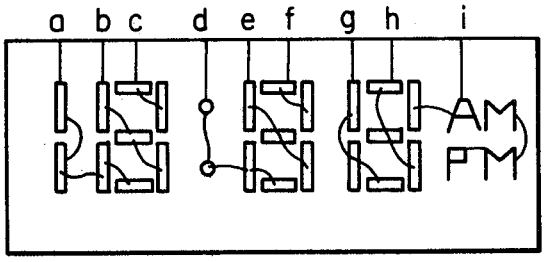
Figure 8:
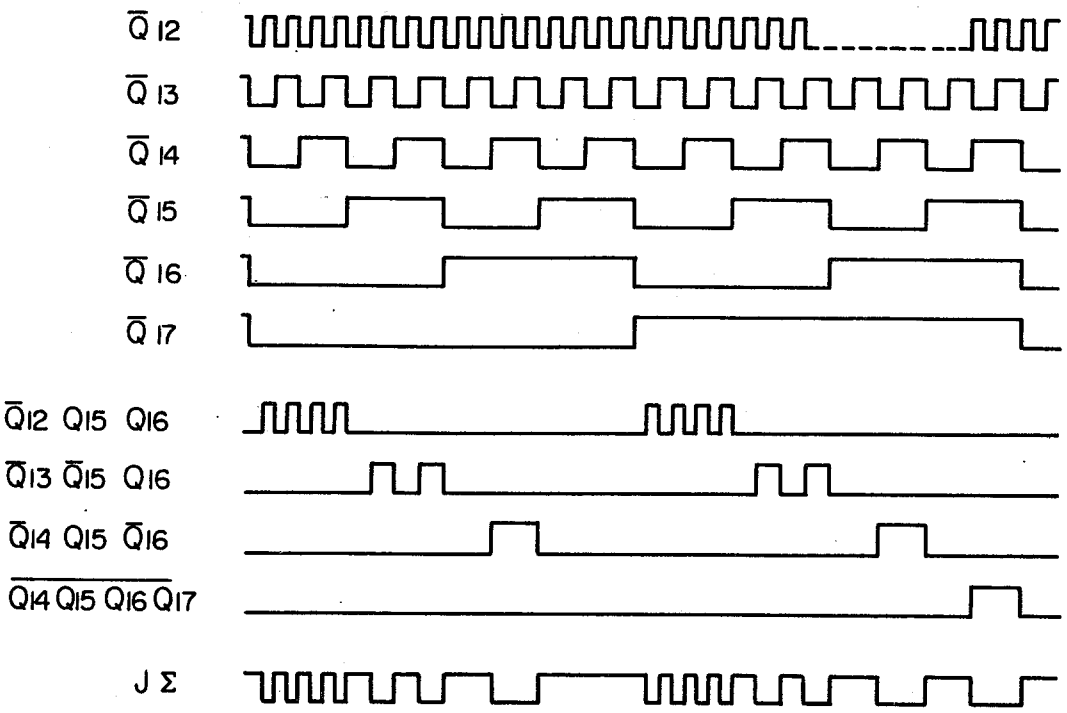
Figure 9:
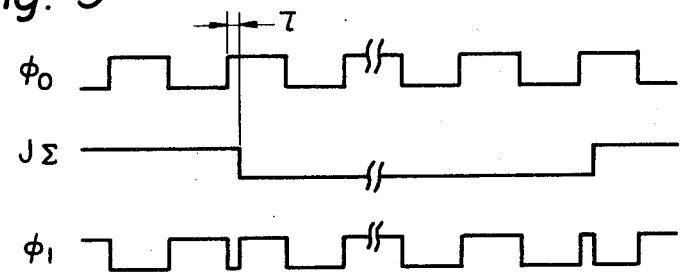
Figure 10:
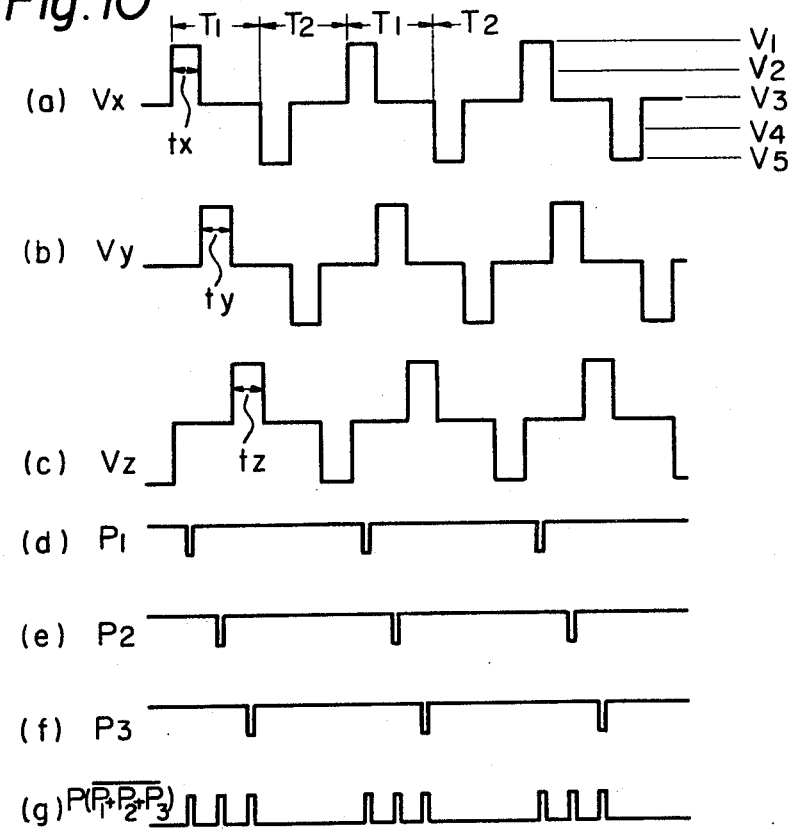

FIG. 7(*a*) and (*b*) show the electrode connections in the time display device illustrated in FIGS. 4A and 4B;

FIGS. 8 and 9 depict waveforms produced in each portion of the variable frequency divider illustrated in FIG. 5; and FIG. 10 depicts waveforms produced in each portion of the circuit illustrated in FIGS. 4A and 4B.

DESCRIPTION OF THE PREFERRED EMBODIMENTS

Figure 1A:
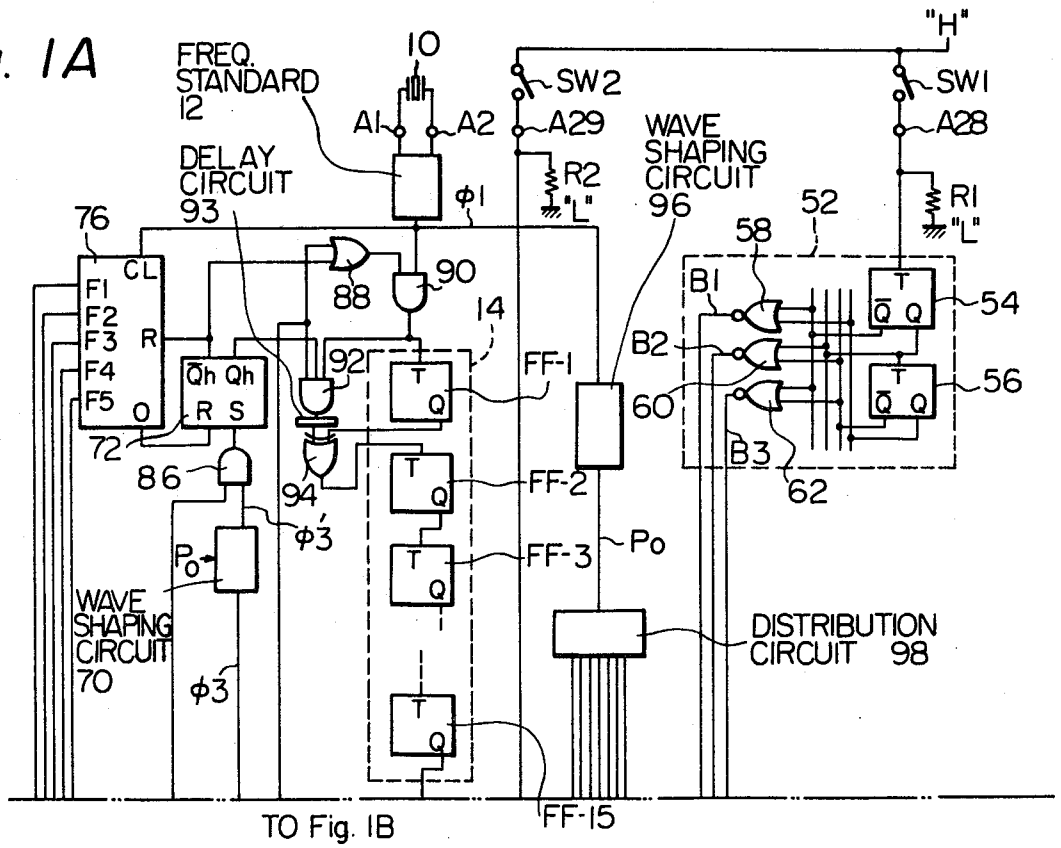
FIGS. 1A through 1C are circuit diagrams which illustrate the respective portions of a preferred embodiment of a digital electronic timepiece according to the invention.
Figure 1B:
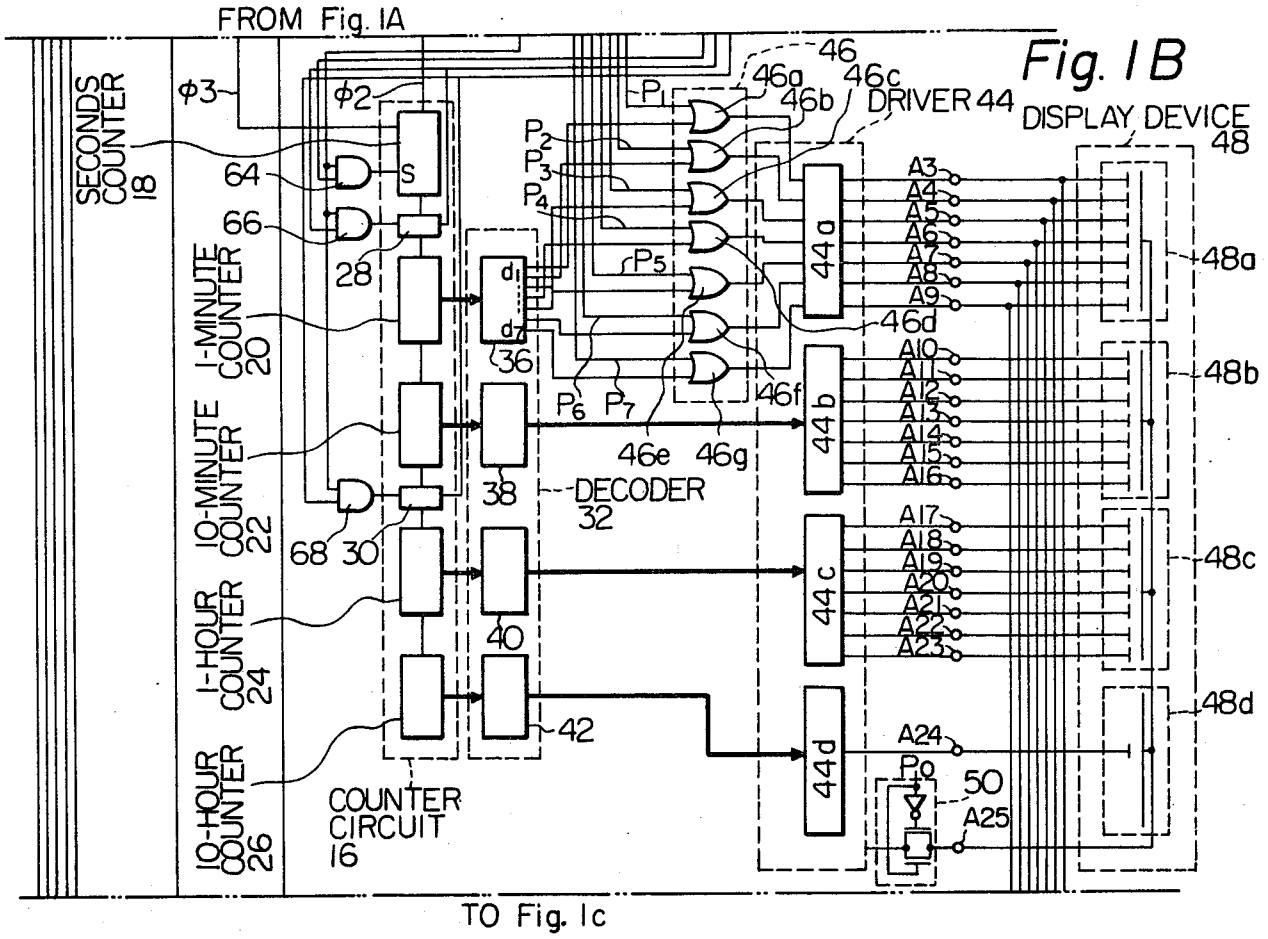
Figure 1C:
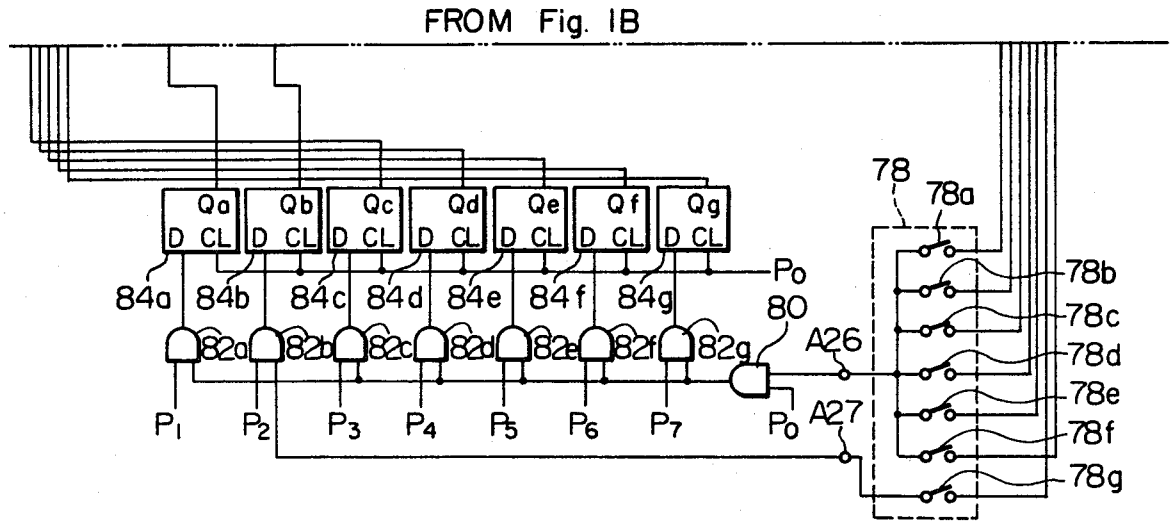
Figure 2:
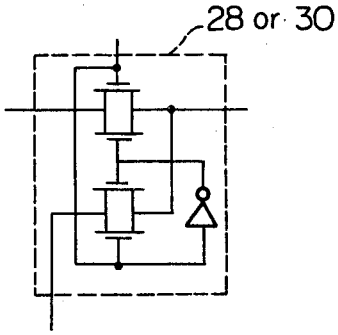
FIG. 2 is a circuit diagram illustrating the switching circuit of FIG. 1.
Figure 3:
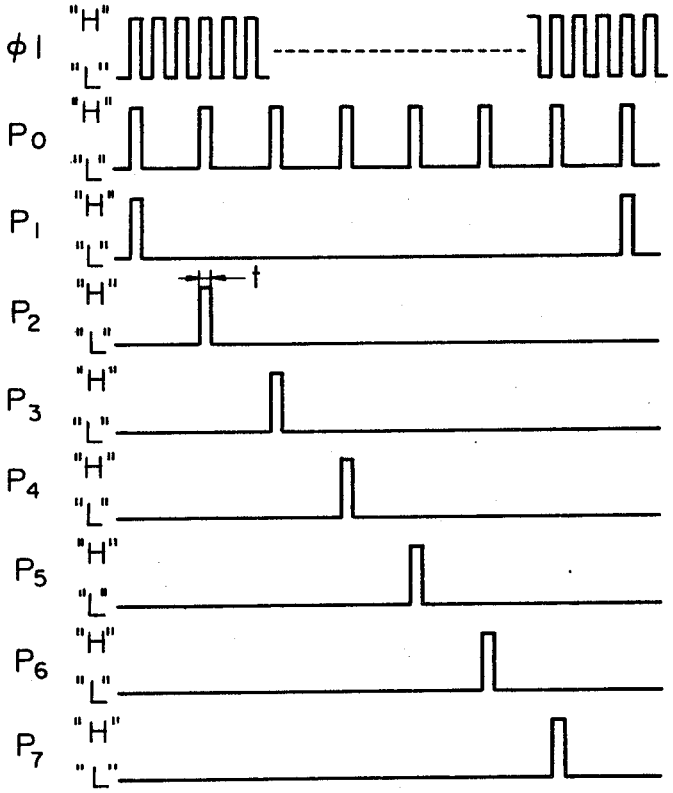
FIG. 3 depicts waveforms illustrative of the input and output signals of distribution circuit shown in FIG. 1.

FIGS. 1A, 1B and 1C are circuit diagrams which illustrate the respective portions of an electronic timepiece in accordance with the invention. Reference numeral 10 denotes a frequency standard such as a quartz crystal oscillator which oscillates at a frequency of 32768 Hz, and reference numeral 12 designates an oscillator circuit which is controlled by crystal oscillator 10, with the interconnection being made through terminals A1, A2. Reference numeral 14 denotes a frequency converter which is constructed of 15 stage flip-flops (hereafter referred to as FF) FF-1 through FF-15 and is adapted to produce a 1 second time unit signal $\phi 2$ by dividing the 32768 Hz output signal $\phi 1$ obtained from the oscillator circuit 12. Reference numeral 16 denotes a counter circuit which constitutes a seconds counter 18, 1-minute counter 20, 10-minute counter 22, 1-hour counter 24, 10-hour counter 26, and a switching circuit comprising transmission gates 28, 30. Reference numeral 32 designates a decoder comprising a 1-minute decoder 36, 10-minute decoder 38, 1-hour decoder 40, and 10-hour decoder 42. A signal from the one minute decoder 36 is coupled to a driver section 44*a* of a driver 44 through a mixer circuit 46 comprising OR gates 46*a*–46*g*. Signals from the driver section 44*a* pass through output terminals A3–A9 and drive a 1-minute display section 48*a* of an electro-optical display device such as liquid crystal display cell 48. Signals from the 10-minute decoder 38 pass through output terminals A10–A16 which originate in the driver section 44*b*, and are connected so as to drive the 10-minute display section 48*b*. 1-hour decoder 40 and 10-hour decoder 42 are constructed so as to drive 1-hour display section 48*c* and 10-hour display section 48*d*, respectively, through the intermediary of driver section 44*c* and output terminals A17–A23, or driver section 44*d* and output terminal A24.

The connection between driver 44 and the line on the common electrode side of liquid crystal display cell 48 is accomplished by means of output terminal A25 and switching circuit 50 which is placed in the OFF state upon the arrival of a signal Po. SW1 denotes a switch for selecting digits during a time correction, one side of the switch being connected to the high logic level (hereafter referred to as H level) side of a power source, the other side of the switch being connected through terminal A 28 to a digit selection and correction circuit 52 as well as to ground, i.e., a low level (hereafter referred to as L level) potential, across a resistor R1. The digit selection and correction circuit 52 comprises frequency dividers 54 56, and NOR gates 58–62, and produces output signals B1–B3 which assume the logic levels shown in Table 1 in response to the number of times switch SW1 is operated.

Table 1

| number of operations of switch SW1 | logic level of output signal | | |
|---|---|---|---|
| | B1 | B2 | B3 |
| 0 | L | L | L |
| 1 | H | L | L |
| 2 | L | H | L |
| 3 | L | L | H |

SW2 denotes a correction switch one side of which is connected to the H level side of the power source while the other side is connected to one input side of respective AND gates 64–68, as well as to ground, i.e., an L level potential, across a resistor R2. The remaining input sides of the AND gates 64–68 are connected so as to receive the output signals B1–B3 produced by the correction circuit 52.

Thus, if the well-known arrangement shown in FIGS. 4A, 4B is adopted when constructing the transmission gates 28, 30, any of the selected counters in counter 16, i.e., either the seconds counter 18, minutes counters 20, 22, or hours counters 24, 26, is advanced, and therefore corrected, in responsive to the number of times switch S2 is operated.

A description will now be made with regard to the construction and operation of means for varying frequency adjustment ratio, i.e., the frequency adjustment means of the present invention.

A 10-second timing signal $\phi 3$ is derived from the intermediate stage of the divider that constructs the second counter 18. Reference numeral 70 denotes a wave shaping circuit that shapes the timing signal $\phi 3$ into pulses, reference numeral 72 denotes as RS flip-flop (hereafter referred to as RS-FF) for calculation control, and reference numeral 76 denotes a counter circuit for varying the frequency dividing ratio. Counter circuit 76 is controlled by the output at the output terminal $\overline{Qh}$ of the RS-FF 72 which is connected to the reset terminal R, and counts standard signals $\phi 1$ which are applied to the clock terminal CL. When the count reaches a value specified by the terminals F1–F5 which establish the counted value, a carrier wave is generated at the output terminal O and resets RS-FF 72. Reference numeral 78 designates a group of setting or adjustment terminals comprising terminals 78*a*–78*e* for establishing the frequency adjustment ratio is counter 76, non-adjustment terminal 78*f*, and terminal 78*g* for establishing the direction of variation, i.e., the terminal which establishes whether the content set by terminals 78*a*–78*e* is to be added to or subtracted from the frequency divider circuit 14. The terminals 78*a*–78*g* may be constructed as switches of rotary or sliding type comprising movable and fixed contacts, or may be composed of wiring patterns which are formed on a circuit board, such as a printed circuit board, and electrically interconnected by means of solder or the like. Terminals 78*a*–78*g* are connected at one end to terminals A3–A9 of the driver section 44*a*, and at the other end, with the exception of terminal 78*g*, to one input side of AND gate 80 through a common terminal A26. The other input side of AND gate 80 is connected so as to receive the signal Po. The other side of the terminal 78*g* for establishing the direction of variation is connected to a terminal A27.

Reference numerals 82*a*–82*g* denote AND gates connected at one input side so as to receive signals P1–P7 and connected at the other input side, with the exception of AND gate 82*b*, to the output side of AND gate 80. The other input side of AND gate 82*b* is connected to terminal A27. Reference numerals 84*a*–84*g* denote D-type flip-flops (hereafter referred to as D-FF) connected such that signal Po is applied to each clock terminal CL, while the respective output signals from AND gates 84*a*–84*g* are applied to the corresponding data input terminals D.

The output terminal $\overline{Qa}$ of D-FF 84*a* is connected to one input side of AND gate 86 for non-adjustment, the output terminal Qb of D-FF 84*b* is connected to one input side of OR gate 88, and the output terminals Qc–Qg of corresponding D-FFs 84*c*–84*g* are connected to the respective counted value setting terminals F1–F5 of the counter circuit 76. Reference numerals 90, 92 denote AND gates for subtraction and addition, respectively, reference numeral 94 designates an EX-OR gate (exclusive-OR gate), and reference numeral 96 denotes a wave shaping circuit for shaping the standard signal $\phi 1$, as obtained from the oscillator circuit, into the waveform Po illustrated in FIG. 5. The output signal Po obtained from wave shaping circuit 96 is broken down by a distribution circuit 98 into offering signals P1–P7 which, through the intervention of mixer circuit 46, are shared with output signals dl–d7 from the 1-minute decoder section 36. The output signals from mixer 46 are supplied to setting terminal group 78 through driver section 44*a* and terminals A3–A9. It is preferable that the signals P1–P7 have a pulse width t which is shorter than the response time of the liquid crystal cell 48 so that the cell is not excited into a state of display.

The means for frequency adjustment constructed as described above operates as follows. First, the output frequency of the frequency standard 12 is detected by some suitable defectector (not shown). In this case, when the detector shows that the frequency standard 12 provides a relatively high frequency signal at a correct frequency of, for example, 32768 Hz, non-adjustment setting terminal 78*f* is set to an ON state. Under this circumstance, a signal composed of the decoder output signal $d_1$ and the offering signal P1 appears periodically at terminal A3 and is passed by non-adjustment setting terminal 78*f* and terminal A26. Due to signal Po at one input side of AND gate 80, offering signal P1 is extracted as the output signal of AND gate 80.This output signal is applied to AND gate 82*a* which thus detects the fact that the terminal 78*f* is in the ON state, this being memorized by D-FF 84*a* the output $\overline{Qa}$ of which attains an L level. As a result, AND gate 90 is turned ON and AND gate 92 is turned OFF so that the standard signal $\phi 1$ from oscillator circuit 12 is passed by AND gate 90, divided down to a 1 Hz time unit signal $\phi 2$ by frequency divider 14, and then coupled to counter circuit 16, decoder 32, driver 44 and liquid crystal display cell 48, all of which operate to produce a prescribed time display. In this state, frequency divider circuit 14 due to its 15 stage FF performs a basic dividing operation; in other words, no frequency adjustment or gain/loss adjustment is accomlished.

The operation of the frequency adjustment means at this time is as follows. As standard signal $\phi 1$ is normally applied to the clock terminal CL of counter circuit 76, a carrier wave appears at output terminal O in accordance with the OFF state or states of frequency adjustment ratio setting terminals 78*a*–78*e* and reset RS-FF 72 so that its output terminal $\overline{Qh}$ attains an H level, thereby resetting counter circuit 76 and simultaneously turning AND gate 90 ON through the intermediary of OR gate 88. Meanwhile, the other output terminal Qh of RS-FF 72 attains an L level, thereby turning AND gate 92 OFF. This state is the previously mentioned non-adjustment state.

Although the non-adjustment state is overcome by applying a pulse to the set terminal S of RS-FF 72, timing signal $\phi 3$ is synchronized with signal Po by the wave shaping circuit 70 which thus produces a timing pulse $\phi'3$ that is blocked by AND gate 86 turned OFF by the non-adjustment setting terminal 78*f*. Accordingly, RS-FF 72 is not set, and frequency divider circuit 14 remains in the non-adjustment state as long as the terminal 78*f* is in the ON state. Moreover, the non-adjustment state is decided solely by terminal 78*f* regardless of the states which exist at the dividing ratio setting terminals 78*a*–78*e* and the variation direction setting terminal 78*g*.

For a case where the frequency adjustment means is to subtract two pulses, frequency adjustment ratio setting terminal 78*d* is set to the ON state, non-adjustment terminal 78*f* to the OFF state, and variation direction setting terminal 78*g* to the OFF state. As a result, offering signal P4 from the distribution circuit 98 is extracted by AND gate 80 after passing OR gate 46*d* of mixer circuit 46, driver section 44*a*, terminal A6, frequency adjustment ratio setting terminal 78*d* and terminal A26. The fact that the ratio setting terminal 78*d* is in the ON state is detected by AND gate 82*d*, whereby the output terminal Qd of D-FF 84*d* is set to an H level. At this time all other setting terminals are in an OFF state so that the outputs obtained from D-FF 84*a*–84*c* and D-FF 84*e*–84*g* attain an L level, the output $\overline{Qa}$ of FF 84*a* being set to an H level which the flip-flop memorizes. Accordingly, AND gate 92 is turned OFF, AND gate 86 is turned ON, and the timing pulse $\phi'3$ produced by oscillator circuit 12, AND gate 90, frequency divider circuit 14, seconds counter 18 and wave shaping circuit 70 is passed by AND gate 86so as to set RS-FF72 the output terminal $\overline{Qh}$ of which reverses in state and assumes an L level, thereby releasing counter circuit 76 from the reset state while simultaneously turning AND gate 90 OFF through OR gate 88.

As the result of these operations, standard signal $\phi 1$ is blocked by AND gate 90 and therefore never reaches the frequency divider circuit 14. On the other hand, counter circuit 76 which has been released from the reset condition counts the number of standard signals $\phi 1$ that arrive at its clock terminal Cl and produces a carrier signal at its output terminal O when the counted value reaches the value 2 as specified by the frequency adjustment ratio setting terminal 78*d*. The carrier wave resets RS-FF 72 so that its output terminal $\overline{Qh}$ once again resets counter circuit 76 and simultaneously turns AND gate 90 ON, whereby the standard signal $\phi 1$ is once again coupled to frequency divider circuit 14 via the AND gate 90.

This operation is repeated whenever RS-FF 72 is set by the timing pulse $\phi'3$. In other words, after RS-FF 72 has been set by timing pulse $\phi'3$, AND gate 90 is placed in the OFF state until RS-FF 72 is reset by the carrier generated by counter circuit 76; hence, the number of pulses subtracted from the standard signal $\phi 1$ is equivalent to the counted value established in the counter circuit 76. More specifically, in the present embodiment a 10-second timing pulse $\phi 3$ is employed and 2 pulses are in effect subtracted from the 32768 Hz standard signal. If this is converted into a daily time difference, the result is a frequency adjustment of approximately-0.53 sec/day. The amount of frequency adjustment can be optionally set by selecting from among the ratio setting terminals 78*a*–78*e*.

For a case where the frequency adjustment means is to add three pulses, frequency adjustment ratio setting terminal 78*c* is set to the ON state, non-adjustment setting terminal 78*f* to the OFF state, and variation direction setting terminal 78*g* to the ON state. As a result, offering signal P5 from the distribution circuit 98 is extracted by AND gate 80 after passing OR gate 46*e* of the mixer circuit 46, driver section 44*a*, terminal A7, frequency adjustment ratio setting terminal 78*c*, and terminal A26. The fact that the ratio setting terminal 78*c* is in the ON state is detected by AND gate 82*e*, whereby the output terminal Qe of D-FF 84*e* is set to an H level. Offering signal P2 from the distribution circuit 98 is extracted by AND gate 82*b* after passing OR gate 46*b* of mixer circuit 46, driver section 44*a*, terminal A4, variation direction setting terminal 78*g* and terminal A27, whereby the output terinal Qb of D-FF 84*b* is set to an H level. At this time all other setting terminals are in an OFF state so that the output terminal Qa of D-FF 84*a* attains an H level, while the output terminals Qc, Qd of D-FF 84*c* and 84*d*, and the output terminals Qf, Qg of D-FF 84*f*, 84*g* each attain L levels, all of these levels being memorized by their respective flip-flops. Accordingly, AND gates 90 and 86 are turned ON. AND gate 92, due to the fact that the variation direction setting terminal 78*g* is in the ON state and in accordance with the condition which exists at the output terminal Qh of RS-FF 72, allows the initial flip-flop (FF-1) of frequency divider 14 to be by-passed. In other words, AND gate 92 is OFF since output terminal Qh is at an L level whenever RS-FF 72 is in the reset state. Hence, the standard signal $\phi 1$ passed by AND gate 90 is divided by all 15 FF stages of the frequency divider circuit 14, including FF-1.However, whenever the timing signal $\phi 3$ is generated and set RS-FF 72,output terminal Qh attains H level and output terminal $\overline{Qh}$ an L level. As a result, AND gate 92 is turned ON and the standard signal passed by AND gate 90 is turned ON and the standard signal passed by AND gate 90 is applied directly to FF-2 via AND gate 92, delay circuit 93 and Ex-OR gate 94. The delay circuit 93 may be dispensed with in a case where the AND gate 92 is composed of a gate having a larger delay time. Counter circuit 76 which has been released from the reset condition by the output terminal $\overline{Qh}$ of RS-FF 72 counts the number of standard signals $\phi 1$ that arrive at its clock terminal CL and produces a carrier at its output terminal O when the counted value reaches the value 3 as specified by the ratio setting terminal 78*c*. The carrier resets RS-FF 72 so that its output terminal $\overline{Qh}$ once again resets counter circuit 76, while its output terminal Qh returns AND gate 92 to the OFF state. In consequence, the addition operation is completed and all 15 stages of frequency divider circuit 14, including FF-1, are allowed to resume their normal dividing operation.

This operation is repeated whenever RS-FF 72 is set by timing pulse $\phi'3$. In other words, after RS-FF 72 has been set by timing pulse $\phi'3$, AND gate 92 is placed in the ON state until RS-FF 72 is reset by the carrier generated by counter circuit 76; hence, the number of pulses added is equivalent to the counted value established in the counter circuit 76. More specifically, in the present embodiment a 10-second timing pulse $\phi 3$ is employed and 3 pulses are, in effect, added to the 32765 Hz standard signal. If this is converted into a daily time difference, the result is a frequency adjustment of approximately + 0.79 sec/day.

In the present embodiment, the number of terminals connected to the seven setting terminals 78*a*–78*g* is a total of nine, namely the seven output terminals A3–A9 and the two terminals A26 and A27. The terminals A3–A9 are indispensable since they provide the connection to the liquid crystal cell 48, and are constructed so as to be combined with the setting terminals 78*a*–78*g*. Accordingly, it can be understood that the timepiece circuitry, namely the semiconductor devices, need substantially to be provided with only two terminals, i.e., terminals A26 and A27, in order to furnish the connection to the setting terminal group 78. Moreover, although five frequency adjustment ratio setting terminals 78*a*–78*e* are provided in the present embodiment, the number can be increased to furnish a wider range of frequency adjustment since the remaining 15 output terminals A10–A24 are solely for use in the liquid crystal display cell 48.

In the present embodiment, a static driving method is adopted to drive the liquid crystal cell 48 which comprises the electro-optical display device. However, a dynamic driving method can also be adopted as another embodiment. Adopting the dynamic driving method allows the number of electrode terminals in the matrix electrode structure of the liquid crystal cell to be reduced in comparison to the number of electrode terminals required in the static driving method; it is therefore possible to further reduce the number of display terminals of the electronic circuitry. In the case of the dynamic driving method it is also possible to adopt a construction wherein driving voltage signals and subdivided signals from the display output terminals of the electronic circuitry are applied to the electrode terminals from either or both of the digit and segment electrodes which constitute the matrix electrode structure of the liquid crystal cell. A construction is also possible in which the control switches are connected to the display output terminals of the electronic circuitry so that the open or closed state of the setting terminals can be detected within the electronic circuitry by the timing signals synchronized with the offering signals.

It should also be understood that the electro-optical display device is not restricted to a liquid crystal cell; it is possible to make use of any customary display device such as light emitting diodes, strongly dielectric ceramic display means, elastomer display means, electrochromic display means, and the like.

In an electronic timepiece having an oscillator circuit equipped with a standard oscillator, a frequency converter for dividing the output signal obtained from the oscillator circuit and equipped with means for varying the frequency adjustment ratio, and time display means driven by the output signals obtained from the frequency converter, the present invention as described above is constructed such that said means for varying the frequency adjustment ratio is provided with frequency adjustment ratio setting terminals connected to the display output electrodes of the display means, whereby a frequency adjustment in the frequency divider circuit is performed depending upon the open or closed state of said ratio setting terminals. This construction allows the frequency adjustment ratio setting terminals to be combined with display output terminals that provide the connection to the electro-optical display device such as a liquid crystal cell, whereby a substantial reduction in the number of circuit terminals can be made and a wide range of frequency adjustment obtained. The reduction in circuit terminals also makes it possible to reduce the size of the semiconductor devices which constitute the electronic circuitry, as well as the number of connections involved in wire bonding or the like for the purpose of inter-connecting terminals on a printed circuit board, etc. Accordingly, costs can be lowered due to a reduction in working hours, while fewer connections assure greater reliability in overall circuit, or semi-conductor, performance. In particular, digital electronic timepieces equipped with electro-optical display means can be provided with a great number of frequency adjustment ratio setting terminals while a substantial reduction can be made in the number of circuit terminals.

Figure 6:
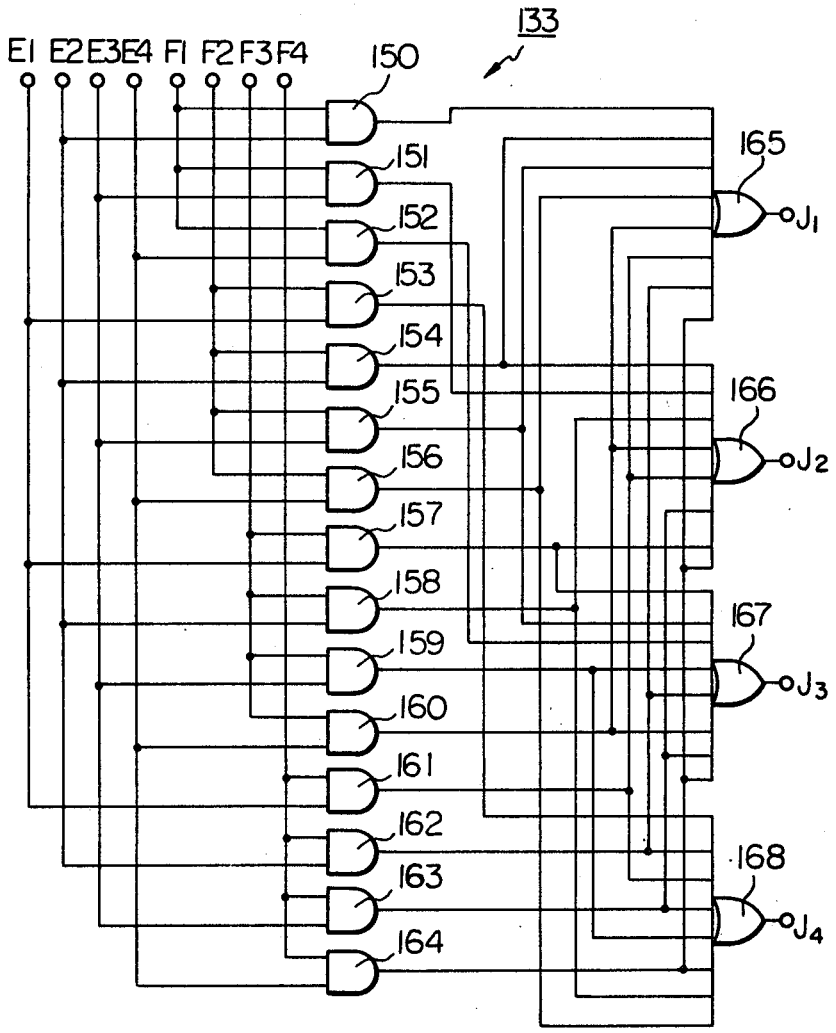
FIG. 6 shows the construction of the condition synthesizing circuit illustrated in FIGS. 4A and 4B.

FIGS. 4A and 4B show a block wiring diagram of another preferred embodiment of an electronic timepiece according to the invention; FIG. 5 shows the construction of the variable frequency divider illustrated in FIGS. 4A, 4B; FIG. 6 shows the construction of the condition synthesizing circuit illustrated in FIGS. 4A, 4B; FIG. 7 shows the electrode connections in the time display device illustrated in FIGS. 4A, 4B; FIGS. 8 and 9 depict waveforms produced in each portion of the variable frequency divider illustrated in FIG. 5; and FIG. 10 depicts waveforms produced in each portion of the circuit illustrated in FIGS. 4A, 4B.

With reference to the drawings, a timepiece IC as indicated at reference numeral 101 is equipped with crystal oscillator connection terminals X1, X2, battery connection terminals $V_{DD}$, $V_{SSL}$, time-share terminals X, Y, Z which provide connection to time display means, segment terminals a–i, ordinary time-correction terminals (not shown), and frequency setting terminals F1, F2. A quartz crystal oscillator 102 is connected to the oscillator connection terminals X1, X2, a battery 103 is connected to the battery connection terminals $V_{DD}$, $V_{SSL}$, and a time display device 104 comprising liquid crystal display elements is connected to the time-share terminals X, Y, Z and the segment terminals a–i. Selection connectors 105, 106 are printed on a circuit board, each composed of a single common terminals 105*d*, 106*d* and three selection terminals 105*a*, 105*b*, 105*c*, 106*a*, 106*b*, 106*c* which are selectively connectable to their respective common terminal 105*d* or 106*d* by means of a solder bridge method or the like. The common terminals 105*d* and 106*d* are connected to respective frequency setting terminals F1, F2 of timepiece IC 101, while the selection terminals 105*a*, 106*a* are connected to time-share terminal X, 105*b*, 106*b* to time-share terminal Y, and 105*c*, 106*c* to time-share terminal Z.

Timepice IC 101 is constructed as follows. A frequency standard or an oscillator circuit as designated at 107 is controlled by the quartz crystal oscillator 102 to generate a 32768 Hz standard signal $\phi 0$. Reference numeral 108 denotes a variable frequency converter or divider the function and operation of which will be described later. The variable frequency divider comprise a main frequency divider 109, auxiliary frequency divider 110, frequency adjustment ratio setting circuit 111, and an exclusive OR gate (hereafter referred to as EXOR gate) 112, and is adapted to vary frequency so as to compensate for errors in the standard signal $\phi 0$ and produced a time unit signal $\phi 2$ having a 1-sec.period. Reference numeral 113 denotes a counter circuit for counting the time unit signals $\phi 2$ and producing time information, reference numeral 114 designates a decoder for converting the time information from counter circuit 113 into display information signals, reference numeral 115 represents a segment drive circuit responsive to display information signals from decoder 114 for the purpose of generating segment drive signals which drive the time display device 104 on a time-share basis or in a matrix driving mode, and reference numeral 116 denotes a time-share drive circuit for driving the time-share or digit electrodes of the display device 104. A booster circuit designated at reference numeral 117 boosts the voltage Vo of battery 103 to five voltage levels V1–V5 in response to a clock signal $\phi c$ supplied by the main frequency divider 109. In the present embodiment, $V1=VDD$, $V2=V_{SSL}$, $V3=2Vo$, $V4=3Vo$, and $V5=4Vo=V_{SSH}$. A drive waveform shaping circuit as designated at 118 in responsive to the five voltage levels from booster circuit 117 and designed to produce a variety of waveforms which are necessary for driving time display device on a time-share basis, the waveforms being supplied to segment drive circuit 115 and time-share drive circuit 116 from terminals Vs, Vcom, respectively. A timing signal generator indicated at 119 receives signals from main frequency generator 109 and produces display drive timing signals at its terminals Pcom, Ps, and sampling signals at its terminals P1–P3. Terminal Pcom also supplies time-share timing signals to time share drive circuit 116 which, in response to the voltage signals applied to its terminal Vcom and time-share timing signals applied to its terminal Pcom, generates at its time-share drive terminals, X, Y, Z the well-known time-share or digit drive signals $V_X$, $V_Y$, $V_Z$ each delayed in phase by 120°, as depicted in FIG. 10. Segment drive circuit 115 is not directly related to the gist of the invention and a detailed description will therefore be omitted except to say that the circuit produces segment drive signals which appear as output signals at its segment drive terminals a–i in response to the voltage signals applied to its terminal Vs and the timing signals applied to its terminal Ps.

A buffer circuit as indicated at 120 comprises an inverter 121 which is operated by the voltage level $V_{SSL}$, and a FET 122 which biases the gate terminal of inverter 121 at the voltage level $V_{SSH}$, the buffer circuit acting as a level shifter which converts the $V_{SSH}$ level signal applied to frequency setting terminal F1 into a $V_{SSL}$ level signal. The output side of inverter 121 which is normally at a 1 logic level reverses state and attains a O logic level only when the voltage level of the time-share signals $V_X$, $V_Y$, $V_Z$ as selectively applied to the input terminal F1 by the selection connector 105 is at the voltage level $V1(V_{DD})$. In other words, when there is no connection between the common terminal 105*d* and the terminals 105*a*–105*c*, the output of the inverter 121 is held at a "1" logic level; if terminals 105*d* and 105*a* are connected, the output of the inverter will undergo a reversal in state and assume a "0" level only during the interval $t_x$ for time-share signal $V_X$ shown in FIG. 10. Similarly, the output of the inverter will assume a "0" logic level only during the interval $t_y$ of time-share signal $V_Y$ when terminals 105*d*, 105*b* are connected, and only during the interval $t_z$ of time-share signal $V_Z$ when terminals 105*d*, 105*c* are connected.

A condition discriminator as designated by reference numeral 123 comprises three data-type flip-flops (hereafter referred to as DEF) 124, 125, 126, three 2-input NOR gates 127, 128, 129 connected to the data terminals D of respective DFFs, and a 3-input NOR gate 130 connected to the output terminal Q of each DFF. The discriminator discriminates among the states of connection in the selection connector 105. More specifically, negative sampling signals as indicated by d, e and f in FIG. 10 and which correspond to the intervals $t_x$, $t_y$, $t_z$ of time-share signals $V_X$, $V_Y$, $V_Z$, and a write-in clock signal P(P1+P2+P3) as indicated by g in FIG. 10, are supplied by the timing signal generator 119 and supplied to the respective sampling terminals P1, P2, P3 and write-in clock terminal P of condition discriminator 123, the outputs of NOR gate 130 and DFFs 124, 125, 126 being connected to discriminator output terminals E1–E4, respectively.

The condition discriminator 123 operates as follows. During the interval T1, the output obtained from buffer circuit 120 is sampled by way of sampling signals and recorded in the DFFs by means of the read-in clock signal. In addition, the discriminator output terminals are set. When the terminals 105*d*, 105*a* of selection connector 105 areconnected, the output side of inverter 121 reverses state and assumes a "0" logic level only during the interval $t_x$ of the time-share signal $V_X$; hence, only the output of NOR gate 127 attains a "1" logic level due to the sampling signal which arrives at P1 and is in synchronism with the interval tx. A "1" logic level is thus established at the output terminal Q of DFF 124, and discriminator output terminal E2 is set as a result. In similar fashion, discriminator output terminal E3 is set when terminals 105*d*, 105*b* of selection connector 105 are connected, and discriminator output terminal E4 is set when terminals 105*d*, 105*c* are connected. When terminal 105*d* is left unconnected, no data is established in the DFFs so that the output of NOR gate 130 attains a "1" logic level thereby setting discriminator output terminal A'1. Thus, condition discriminator 123 discriminates among 4 conditions or states, namely the states in which the common terminal 105*d* of the selection connector 105 is unconnected or connected to any one of terminals 105*a*, 105*b* or 105*c*, whereby the one terminal from among the discriminator output terminals E1–E4 corresponding to one of the above-mentioned conditions is set.

Designated at 131 and 132 are respective buffer and condition discriminator circuits corresponding to the other selection connector 106. Condition discriminator 132, through the same construction and operation as condition discriminator 123, sets its discriminator output terminals F1–F4 as dictated by the state of selection connector 106. A condition synthesizing circuit as indicated at 133 generates 16 varieites of frequency adjustment ratio setting signals at its output terminals J1–J4 by combining input signals which arrive from the discriminator output terminals E1–E4 and F1–F4 of condition discriminator circuits 123, 132, respectively.

FIG. 5 shows the detailed construction of the variable frequency divider 108 illustrated in FIGS. 4A, 4B and FIGS. 8 and 9 depict waveforms produced in each portion of the variable frequency divider. Frequency adjustment ratio setting circuit 111 comprises four 4-inputAND gates 140, 141, 142, 143, a 4-input NOR gate 144, and a 2-input AND gate 145. Auxiliary frequency divider circuit 110 comprises two flip-flop circuits FF16 and FF17. Variable frequency divider 108 is designed to perform a 16-stage, positive frequency adjustment at minimum steps of 7.5 PPM. The frequency-divided waveforms $\overline{Q}$12–$\overline{Q}$17 in FIG. 8 are the waveforms which appear at the output terminals of respective flip-flops FF 12–FF 17. During normal frequency dividing operation, the frequency adjustment ratio of FF 1–FF 17 is 131072, the output Q17 obtained from FF 17 being a signal having a period of four seconds. If the outputs obtained from these FFs are combined in the AND gates 140–143, the offering pulses shown in FIG. 8 can be made to appear at the output side of the AND gates. In other words, there will be produced at the output of AND gate 140 a signal $\overline{Q}$12Q15Q16 in which 8 pulses appear in four seconds, at the output of AND gate 141 a signal $\overline{Q}$13Q15Q16 in which four pulses appear in four seconds, at the output of AND gate 142 a signal $\overline{Q}$14Q15Q17 in which two pulses appear in four seconds, and at the output of AND gate 143 a signal $\overline{Q}$14Q15Q16Q17 in which 1 pulse appears in 4 seconds. Since none of these pulses overlap, from zero to fifteen pulses or sixteen states can be chosen to appear as the output pulses produced at the output terminal $J_{93}$ of the frequency adjustment ratio setting circuit 111, this being determined by establishing "1" or "0" logic levels at the output terminals J1–J4 of the condition synthesizing circuit 133. $J_\Sigma$ in FIG. 8 indicates a pulse train for a case in which a "1" logic level has been established at all of the terminals J1–J4.

FIG. 9 illustrates an addition operation performed by EXOR gate 112. $\phi 0$ indicates a portion of the 32768 Hz standard signal obtained from the oscillator circuit 107, and $J_{93}$ a portion of the output pulse obtained from the frequency adjustment ratio setting circuit 111. The timing of the positive-going and negative-going portions of these pulses is effected by transit time through the frequency divider and gate circuity so that a slight time delay $\tau$ develops. Accordingly, when all terminals J1–J4 are at a "0" logic level, terminal $J_\Sigma$ attains a "1" logic level. Although the EXOR gate 112 is merely an inverter, it produces an output signal $\phi 1$ in which a pulse having a width $\tau$ is inserted in the $\phi 0$ pulse train whenever $J_\Sigma$ changes. In other words, variable frequency divider 108, since it counts the extra pulses inserted in $J_\Sigma$ during the output period of FF 17 and does not count the standard signal $\phi 0$, shortens the period of the time unit signal $\phi 2$ by the number of counted extra pulses. In the present embodiment, the variable frequency range of the variable frequency divider 108 lies between 7.5PPM when only terminal J1 is at a "1" logic level and 112.5Pm (60+30+15+7.5) when all terminals J1–J4 are at a "1" logic level. This is equivalent to a maximum daily time difference of 9.7 sec/day.

FIG. 6 shows the detailed construction of the condition synthesizing circuit 133. The circuit is constructed of fifteen 2-input AND gates 150–164 each of which receive an input signal from the condition discriminators 123, 132, and four OR gates 165–168 which combine the outputs produced by said AND gates, whereby the conditions which exist at the discriminator output terminals E1–E4 and F1–F4 are synthesized so as to set the output terminals J1–J4 to 16-stage conditions. FIG. 7 shows the most generally employed tri-sected system of the electrode connections in driving on a time-share basis the time display device 104 composed of liquid crystal display elements, FIG. 7(*a*) showing the time-share or digit electrode connections and FIG. 7(*b*) the segment electrode connections.

The operation and frequency adjustment of the timepiece having this structure is as follows. Under an initial condition, selection connectors 105 and 106 are left unconnected so that condition discriminators 123 and 132 set all output electrodes J1–J4 of condition synthesizing circuit 133 to a "0" logic level, whereby the frequency adjustment ratio of variable frequency divider 108 is determined by the number of FF stages that constitute the main frequency divider 109. Accordingly, the time unit signal $\phi 2$ produced by oscillator circuit 107 and main frequency divider 109 includes a certain error. The time information from counter circuit 113 as driven by the time unit signal $\phi 2$ is converted by decoder 114 to time display information signals and then displayed on the time display device 104 through the intermediary of segment drive circuit 115 and time-share drive circuit 116 which are controlled by the drive waveform shaping circuit 118 and timing signal generator 119. The frequency of the standard signal $\phi 0$ is now measured by some suitable external detector (not shown) and variable frequency divider 108 is allowed to perform an adding operation by selectively making connections within the selection connectors 105 and 106 so as to compensate for the standard signal error; accordingly, accurate time information is produced by virtue of the compensated time unit signal $\phi 2$.

The invention as described above thus adopts a system in which a selective connection is made between frequency setting terminals and time-share drive terminals which generate time-share drive signals that differ in phase, these signals being converted to frequency adjustment ratio setting signals by means of the condition discriminator circuits and condition synthesizing circuits. This system therefore makes it possible to obtain a large number of levels with a small number of frequency setting terminals. In contrast to the prior art in which the number of obtainable levels was the square of the number of setting terminals, the number of levels K which can be established in the present system is expressed by $$K=(M+1)^N,$$

where M is the number of selection levels in one selection connector, and N is the number of frequency setting terminals. Thus, as in the present embodiment, 16 levels can be established with two frequency setting terminals i.e., F1 and F2, whereas only four levels could be established in the prior art. Moreover, twenty five levels can be established if the time display device 104 makes use of four digit electrodes. Furthermore, sixty four levels can be established in the present embodiment if 3 frequency setting terminals are adopted.

It follows from the above that far-reaching effects can be obtained by applying the system of the invention to an electronic timepiece that makes use of a time display device such as a light emitting diodes which require a large number of time-share levels. In the case of such a light emitting diode display device, the buffer circuit need not function as a level shifter since the time-share signals generated at the time-share terminals possess only two potential levels. Furthermore, although the variable frequency divider 108 in the present embodiment includes the auxiliary frequency divider 110, this can be omitted by constructing the counter circuit 113 such that its seconds counter is composed of two stages, namely a divide-by-4 counter and a divide-by-6 counter, the divide-by-4 portion incorporating the two flip-flops FF16 and FF17.

The second preferred embodiment as described adopts a system in which the output electrodes that supply information to the time display device are combined with the frequency setting electrodes, thereby making it possible to obtain a wide range of frequency adjustment with a small number of terminals. It is therefore possible to eliminate a trimmer condenser without increasing labor, cost or circuitry size, an advantage which allows more reliable electronic timepieces to be reduced in size and lowered in cost.

What is claimed is:

1. An electronic timepiece comprising:

an integrated circuit chip including a frequency standard providing a relatively high frequency signal, a frequency converter for dividing down the relatively high frequency signal to provide a low frequency time unit signal, a time counter circuit responsive to the low frequency time unit signal to provide time information signals, a decoder coupled to the time counter circuit for providing display information signals in response to the time information signals, and a driver circuit responsive to the display information signals to provide drive signals;

an electro-optical display device responsive to the drive signals to provide a display of time information; and a frequency adjustment circuit for adjusting a frequency of said relatively high frequency signal to a correct value;

said frequency adjustment circuit including a plurality of frequency adjustment ratio setting terminals provided on said integrated circuit chip and adapted to be selectively coupled to output terminals of said driver circuit, respectively, to provide output signals indicative of frequency adjustment ratios, means for generating output pulses in number in dependence on said output signals, and means for adjusting said relatively high frequency signal to said correct value in response to said output pulses.

2. An electronic timepiece according to claim 1, in which said frequency adjustment circuit further includes a condition discriminator circuit coupled through a common terminal to said plurality of frequency adjustment ratio setting terminals to detect one of said output signals when generated.

3. An electronic timepiece according to claim 1, in which said frequency adjustment circuit further includes a condition synthesizing circuit responsive to said output signals to provide a plurality of frequency adjustment ratio indicating signals in response to said output signals, said output pulse generation means being responsive to one of said plurality of frequency adjustment ratio indicating signals to produce said output pulses.

4. An electronic timepiece according to claim 1, in which said frequency adjustment circuit further includes a pulse generation circuit for generating offering pulses in response to said relatively high frequency signal, and a mixer circuit having first inputs coupled to said pulse generation circuit to receive said offering pulses and second inputs coupled to said decoder for mixing said offering pulses and said display information signals.

5. An electronic timepiece according to claim 2, in which said frequency adjustment circuit further includes a timing signal generation circuit for generating sampling signals in synchronism with said display information signals, and in which said condition discriminator circuit includes detecting means for detecting said one of said output signals in response to said sampling signals.

6. An electronic timepiece according to claim 1, in which said driver circuit comprises a segment drive circuit to provide segment drive signals, and a time-share drive circuit to provide time-share or digit drive signals, whereby said electro-optical display device is driven on a time-share basis.

7. An electronic timepiece according to claim 6, in which said plurality of frequency adjustment ratio setting terminals are connected to output terminals of said time-share drive circuit.

8. An electronic timepiece according to claim 1, in which said frequency adjustment circuit further includes a non-adjustment terminal connected to another output terminal of said driver circuit to disenabling said output pulse generation means and said adjusting means.

9. An electronic timepiece according to claim 1, in which said frequency adjustment circuit further includes an additional terminal connected to another output terminal of said driver circuit for determining the direction of frequency adjustment.

10. An electronic timepiece according to claim 3, in which said output pulse generating means comprises a frequency adjustment ratio setting circuit connected to said condition synthesizing circuit for providing said output pulses in response to said frequency adjustment ratio indicating signals.

11. An electronic timepiece according to claim 1, in which said plurality of frequency adjustment ratio setting terminals are connected at one end to the output terminals of said driver circuit and connected at the other end to a common terminal provided on said integrated circuit chip.

12. An electronic timepiece according to claim 1, in which said electro-optical display device comprises a liquid crystal display device.

* * * * *